United States Patent [19]

Taniguchi

[11] 4,303,143

[45] Dec. 1, 1981

[54] EXHAUST GAS CONTROL SYSTEM

[75] Inventor: Yoshifumi Taniguchi, Toyonaka, Japan

[73] Assignee: Mitsuko Leith, Honolulu, Hi.

[21] Appl. No.: 116,193

[22] Filed: Jan. 28, 1980

[51] Int. Cl.[3] ..... F01N 1/12; F01N 1/14

[52] U.S. Cl. ..... 181/263; 181/279

[58] Field of Search ..... 181/262, 263, 279, 280

[56] References Cited

U.S. PATENT DOCUMENTS 1,388,107 8/1921 Ernst ..... 181/279 X

FOREIGN PATENT DOCUMENTS 1085924 8/1954 France ..... 181/280

594110 5/1959 Italy ..... 181/280

5598 of 1895 United Kingdom ..... 181/279

*Primary Examiner*—L. T. Hix

*Assistant Examiner*—Thomas H. Tarcza

*Attorney, Agent, or Firm*—James C. Wray

[57] ABSTRACT

An exhaust gas control system has a proximal end for connection to a distal end of an exhaust pipe and has a first divergent and convergent and second divergent portions. Curved spiralling blades extend around inner walls of the first divergent and convergent portions leaving an open central space about which exhaust gas whirls. The second divergent portion exhausts the swirling gas through a distal opening. A duct surrounds the convergent and second divergent portions and controls flow of ambient air over those portions.

9 Claims, 2 Drawing Figures

EXHAUST GAS CONTROL SYSTEM

BACKGROUND OF THE INVENTION

Automobile exhaust gas control is subjected to severe regulatory measures today, and the tendency is towards the imposition of even more vigorous performance standards. The results are high fuel consumption, a considerable reduction in power output and greater noise from the engine which combine to make poorer performance.

SUMMARY OF THE INVENTION

This invention provides an exhaust gas guiding pipe having a proximal end configured for attachment to a distal end of an engine exhaust pipe. The guiding pipe has a first divergent portion beginning with the proximal intake end and a second convergent portion spaced from the intake end. A series of spiralling blades is connected to an inner wall for spiralling exhaust gasses from the exhaust pipe.

Preferably the spiralling blades extend throughout the divergent and convergent portions. A central portion of the diverging and converging portions is open throughout the guiding pipe. The spiralling blades centrally converge near the intake end of the guiding pipe. A second divergent portion connected at an outer end of the convergent portion has a distal opening for releasing the exhaust gas.

In a preferred embodiment a duct has supporting plates connected to the converging and second diverging portions of the guiding pipe. The duct opens adjacent the convergent portion and has an outlet positioned rearward from the distal opening of the guiding pipe.

These and other objects and features of the invention are apparent in the above and ongoing specification, with the claims and in the drawings.

DETAILED DESCRIPTION OF THE DRAWINGS

This invention improves the aspects of car performance. The invented system is simple in structure, and its manufacturing cost is reasonably low. The system is fitted simply at the end of the exhaust pipe, where it may contribute to a saving of fuel consumption, engine power, and a decrease in noise.

Figure 1:
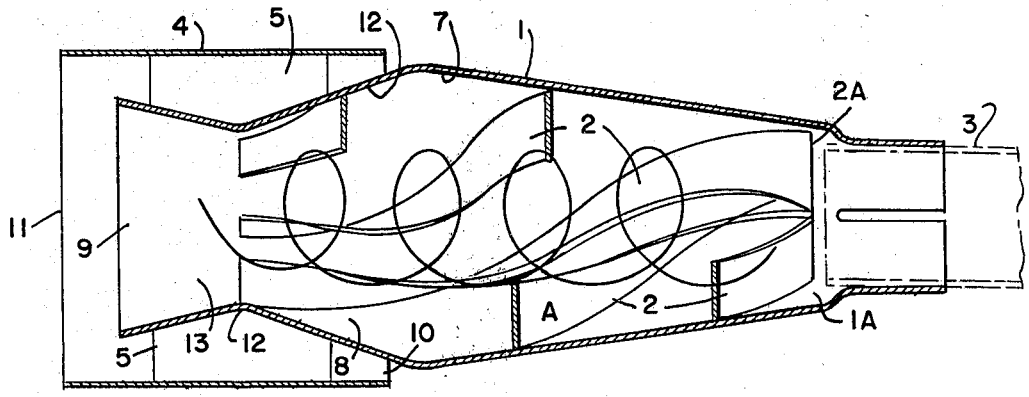
FIG. 1 is a side elevation, partially in section, showing the construction of an exhaust gas control system of the present invention.
Figure 2:
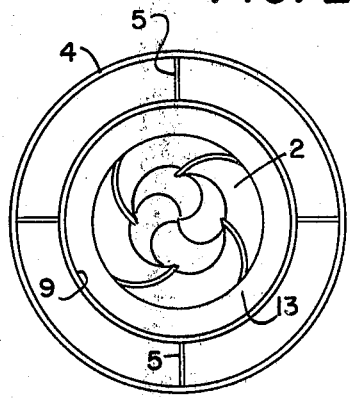
FIG. 2 is a view taken along line 2—2 of FIG. 1.

FIGS. 1 and 2 show examples of the way this system is installed. In these illustrations guiding pipe 1 of the venturi type has a larger diameter in its center and a smaller diameter at its ends. The inside of pipe 1 is fitted with a series of blades 2 which are spaced in a spiral arrangement about expanding chamber wall 7. The intake end chamber 1A of pipe 1 opens abruptly outward so that the forward edges 2A of blades 2 do not restrict flow or reduce the cross-sectional flow area at the end of exhaust pipe 3.

Exhaust pipe 3 connects pipe 1 with the engine exhaust. Duct 4 is installed at the outer end of the guiding pipe 1 by means of supporting plates 5. Duct 4 helps reduce the temperature of the guiding pipe 1, which may increase substantially during the operation. Duct 4 channels ambient air in through intake 10 and over guiding pipe 1 by virtue of the venturi suction caused by exhaust gas flowing rearward from opening 9 in pipe 1. The flow through duct 4 is promoted while the vehicle is in motion by ram air through intake 10 and may be promoted by reduced air pressure at outlet 11 by virtue of gas flowing therefrom and air flowing thereabout. More complete oxidation may take place and the emission temperature is reduced thereby reducing pollutants.

In the gas exhaust control system of this innovation, the exhaust gas from the exhaust pipe 3 is channeled through the guiding pipe 1, where the gas flows in whirls along the blades 2 as indicated by line A in the attached drawing. The whirls A are so forceful that gaseous pressure at the center of these whirls A becomes extremely low. This increases the sucking ability of the guiding pipe 1. The exhaust gas released from the exhaust pipe 3 is absorbed into the guiding pipe 1 with maximum efficiency.

At the same time the gas is expanded in the passageway 7 and cooled along its outer surface, which further reduces pressure. The swirling gasses enter the convergent chamber 8 and then speed increases through the throat area 12. The gasses are uniformly expanded with reduced speed in chamber 13 until they reach opening 9. At all times a reduced pressure is maintained near the center line.

The increased velocity and improved smoothness in the exhaust gas flow through the exhaust pipe 3 result in a full absorption of the exhaust gas and carbon from the engine cylinders. In this way, improved combustion and fuel consumption saving, increased engine power, reduced noise, and/or reduced emission temperatures may be achieved.

This invention is applicable to all types of cars since no difficulty is involved in installation at the end of the exhaust pipe 3.

It should also be noted that the efficiency of this new system improves in parallel with the higher rotations of the engine, and with higher speed of the car. A faster flow of exhaust gas prompts the spiral motion of the whirls A and the gas becomes thinner in the center of the guiding pipe 1. As a result, the sucking power 10 improved. With this system, therefore, merit may be found in the saving of fuel consumption when the car runs at high speeds and otherwise consumes more fuel.

Needless to say, this system is applicable not only on gasoline engine vehicles but on diesel engine cars as well.

I claim:

1. An exhaust gas control system comprising an exhaust gas guiding pipe having a proximal end configured for attachment to a distal end of an exhaust pipe, the guiding pipe having a first divergent portion beginning with the proximal intake end and having a second convergent portion spaced from the intake end and having a plurality of longitudinally extending spiralling blades centrally converging adjacent said proximal end for spiralling exhaust gasses from the exhaust pipe.

2. The exhaust gas control system of claim 1 where the spiralling blades extend throughout the divergent and convergent portions.

3. The exhaust gas control system of claim 2 further comprising a second divergent portion connected at an outer end of the convergent portion, the divergent portion terminating outwardly in a distal opening for releasing the exhaust gas.

4. The exhaust gas control system of claim 3 further comprising a duct having supporting plates connected to the converging and second diverging portions of the guiding pipe, the duct opening adjacent the convergent portion and having an outlet positioned rearward from the distal opening of the guiding pipe.

5. The exhaust gas control system of claim 4 wherein a central portion of the diverging and converging portions is open throughout the guiding pipe.

6. The exhaust gas control system of claim 1 wherein a central portion of the diverging and converging portions is open throughout the guiding pipe.

7. The exhaust gas control system of claim 4 wherein the duct has a substantially cylindrical shape.

8. The exhaust gas control system of claim 4 wherein the supporting plates comprise plural longitudinally extending plates circumferentially spaced about the guiding pipe.

9. The exhaust gas control system of claim 1 wherein the second convergent portion begins at an outer end of the first divergent portion.

* * * * *